US007624599B2

(12) United States Patent
Dietz et al.

(10) Patent No.: US 7,624,599 B2
(45) Date of Patent: Dec. 1, 2009

(54) KNITTING TOOL FOR A KNITTING MACHINE

(75) Inventors: Andreas Dietz, Geislingen (DE); Torsten Butz, Messstetten (DE); Klaus Kirchmair, Nusplingen (DE); Eric Jürgens, Bisingen (DE); Ernst-Viktor Heinemann, Renquishausen (DE); Hubert Siber, Schwenningen (DE); Ingo Zimmermann, Balingen (DE); Eckhard Fehrenbacher, Tübingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/285,335

(22) Filed: Oct. 2, 2008

(65) Prior Publication Data

US 2009/0084143 A1 Apr. 2, 2009

(30) Foreign Application Priority Data

Oct. 2, 2007 (EP) ..... 07019323

(51) Int. Cl.
*D04B 35/02* (2006.01)

(52) U.S. Cl. ..... 66/123

(58) Field of Classification Search ..... 66/116, 66/123, 124, 208
See application file for complete search history.

(56) References Cited

U.S. PATENT DOCUMENTS

| | | | | | |
|---|---|---|---|---|---|
| 4,452,053 | A * | 6/1984 | Egbers et al. | ..... | 66/123 |
| 4,553,411 | A * | 11/1985 | Schuler et al. | ..... | 66/123 |
| 4,562,705 | A * | 1/1986 | Berentzen | ..... | 66/121 |
| 4,625,527 | A * | 12/1986 | Fukuhara | ..... | 66/123 |
| 4,783,976 | A * | 11/1988 | Sos | ..... | 66/121 |
| 4,817,399 | A * | 4/1989 | Sos et al. | ..... | 66/123 |
| 5,029,456 | A * | 7/1991 | Sos et al. | ..... | 66/123 |
| 5,094,091 | A * | 3/1992 | Treuz et al. | ..... | 66/123 |
| 5,582,038 | A * | 12/1996 | Braun et al. | ..... | 66/123 |
| 5,937,674 | A * | 8/1999 | Horn | ..... | 66/123 |
| 6,892,556 | B2 * | 5/2005 | Landenberger | ..... | 66/123 |

FOREIGN PATENT DOCUMENTS

| | | |
|---|---|---|
| DE | 33 36 212 | 1/1985 |
| DE | 44 42 943 | 5/1996 |

* cited by examiner

*Primary Examiner*—Danny Worrell
(74) *Attorney, Agent, or Firm*—Fitch, Even, Tabin & Flannery; Norman N. Kunitz

(57) ABSTRACT

A knitting tool for a bar (1) of a knitter comprises a shaft (4), which is provided with a plastic body (15) at least on one side, which extends beyond the side surface (11) of the shaft. Said plastic body (15) is in contact with the side surface of the adjacent knitting tool. Thus, both knitting tools concerned are supported at one another.

13 Claims, 2 Drawing Sheets

KNITTING TOOL FOR A KNITTING MACHINE

CROSS-REFERENCE TO RELATED APPLICATION

The present application claims priority based on European Patent Application No. 07 019 323.0, filed Oct. 2, 2007, the entire disclosure of which is hereby incorporated by reference in its entirety.

BACKGROUND OF THE INVENTION

The invention relates to a knitting tool, which is configured for stationary support in a bar, which is supported stationary or movable.

Knitters (warp knitting machines) comprise one or plural bars, which are respectively equipped with a large number of knitting tools, e.g., slider needles or tongue needles. The designation "knitting tools" also includes tools for warp knitting machines. Said knitting tools are aligned in parallel to one another, and clamped at the needle bar. They perform the same motion as the needle bar.

At the needle bar, each particular knitting tool has to be fixated in a predetermined position. In order for each knitting tool to remain fixated in its predetermined position, respective positioning means are provided at the bar, e.g. in the form of slots or grooves, into which the particular knitting tools are inserted. The knitting tools are then clamped in the respective groove.

The number of the knitting tools disposed in a needle bar depends on the textile material to be manufactured, in particular its stitch density. For the time being, the finest knitted textile knitwear is produced on a machine with the yarn count E44. This means that an inch (25.4 mm) comprises 44 knitting tools or needles. This creates a pitch of 0.5773 mm. The pitch defines the distance of one knitting tool to another. The knitting tools for an E44 pitch comprise a thickness 0.44 mm. The bar between the knitting tools comprises a thickness of 0.16 mm. When knitwear with a coarser pitch is produced, e.g., E40, knitting tools with greater thickness and bars with greater widths are required. For each pitch, a particular thickness of the knitting tools and a particular bar thickness is required. This requires producing individual knitting tools and needle bars for each pitch.

The knitting tools extend over a certain distance from the bar, wherein they comprise certain flexibility due to their material properties.

When there is a preliminary or permanent bending of the knitting tools, this causes the formation of stripes and/or faults in the knitwear.

Thus, the correct positioning of the knitting tools and the sufficient support of the shafts reaching away from the needle bar are very important for the quality of the knitwear to be produced.

Knitting tools for knitters are known which comprise plastic inlays. For example, DE 44 42 943 C1 and also DE 33 14 809 disclose needles, whose shafts comprise openings which are filled with plastic or vibration absorbing material.

Thus, the plastic bodies disposed in the openings terminate in the same planes as the lateral surfaces of the knitting tools.

From JP 57-9433, furthermore a light-knit fabric knitting needle is known, which is configured as tongue needle. It is provided with plastic slider bodies at its shaft, which protrude beyond the lateral surface of the shaft. Said plastic slider bodies absorb vibrations and hold the needles in their needle channels by sliding at the wall surfaces.

It is thus the object of the invention to provide a knitting needle, which solves the problems described above, so that a particularly stable and precise support of the knitting tools at the bar is facilitated.

SUMMARY OF THE INVENTION

This object is accomplished by the knitting tool according to patent claim 1.

The knitting tool according to the invention is provided with a shaft, which is configured for stationary support at a bar. Thus, a first shaft section is held in the bar, while a second shaft section protrudes from the bar. At least one plastic body is held at the bar, which protrudes beyond at least one of the lateral surfaces of the knitting tool.

The plastic body is preferably anchored in at least one or also in plural openings of the shaft.

The plastic body can be used for vibration absorption and for stiffening. In its preferred embodiment, it supports the positioning of the knitting tool by facilitating, e.g., a mutual support of adjacent knitting tools. Thus, it forms a support means for supporting adjacent knitting tools at one another. The plastic body can thus protrude on one side beyond the lateral surface of the knitting tool, so that it touches the lateral surface of the adjacent knitting tool. Thus, a temporary flexible bending of the shaft, a remaining deformation of the shaft, or also a false positioning through vibrations is mostly avoided.

When the plastic body only extends from a lateral surface of the shaft, the knitting tool is asymmetrical in top view. However, it is also possible to let the plastic body protrude beyond both lateral surfaces of the knitting tool, so that a configuration, which is symmetrical in top view, is created. Then the plastic bodies of adjacent needles touch one another (plastic on plastic).

The overhang of the plastic body beyond the lateral surface of the knitting tool preferably corresponds to the desired lateral distance of adjacent knitting tools, and thus corresponds to the thickness of the bars of the needle bar, disposed between the needles. The overhang of the plastic body fills the gap outside of the needle bar between two adjacent knitting tools, which are disposed according to the pitch.

The plastic body is preferably disposed at the shaft section, which protrudes from the bar. If necessary, however, it can be disposed entirely or partially at the shaft section disposed in the bar. The disposition of the plastic body at the shaft section located outside of the bar provides the ability to support the knitting tools at one another in direct vicinity of their respective working section; this means, e.g., its hook, whose positioning is thus improved.

By using a plastic body for bridging the gap of two adjacent knitting tools outside of the needle bar, it is possible to use knitting tools for a coarse yarn count, which are provided for a finer yarn count. Thus, a weight reduction of the entire system of the needle bar with knitting tools can be facilitated.

The anchoring of the plastic body at the shaft is preferably form locked. For this purpose, the shaft can comprise one or plural openings, through which the plastic body reaches. The plastic body can be produced separately and can be subsequently mounted to the shaft. It is preferred, however, to mold it directly at the shaft, wherein the plastic body comprises one or plural extensions, which, e.g., reach through the shaft at its openings. The openings for this purpose can, e.g., be provided with an expansion at the rim facing away from the plastic body, in order to anchor the plastic body in a form locked manner at the shaft. Said extension can be formed in the form of a conical recess, e.g., of a funnel or a similar structure.

Thus, the recess can form electively either an obtuse angle or an acute angle with the opening through which the plastic body reaches. The disposition and the size of the recess can be selected so that the plastic body is securely anchored in the knitting tool. When the shaft has plural openings for mounting the plastic body, the recesses of the particular openings can have different shapes and sizes.

Additional details of advantageous embodiments of the invention are obvious from the description. It is restricted to the presentation of essential aspects of the invention and miscellaneous situations. The drawings disclose additional details and are meant to supplement the description.

DETAILED DESCRIPTION OF THE INVENTION

Figure 1:
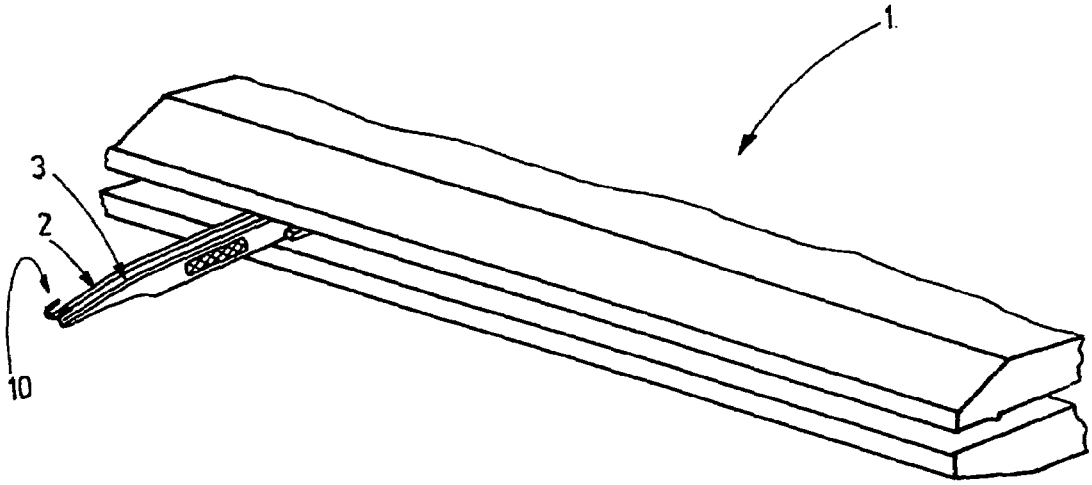
FIG. 1 shows a bar with a group of knitting needles in a perspective exploded view.
Figure 2:
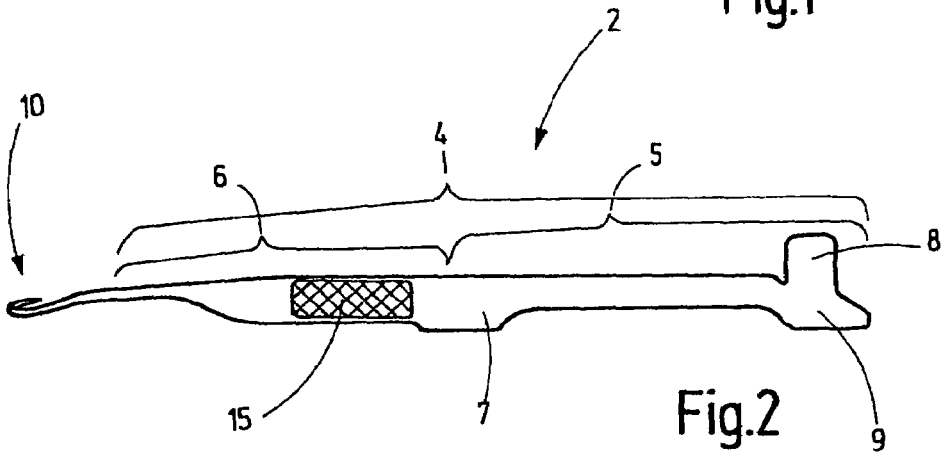
FIG. 2 shows one of the knitting needles of the bar according to FIG. 1 in side view.

In FIG. 1, a bar 1 is illustrated, which belongs into a knitting machine, which is not shown in more detail. The bar supports a large number of knitting tools, here, e.g., knitting needles 2, 3, distributed over its length. The two knitting needles 2, 3 represent a group of knitting needles extending over the entire length of the bar 1.

The knitting needles 2, 3 are preferably configured completely identical among one another. Such a knitting needle 2 is shown separately in the FIGS. 2 through 6. The knitting needle 2 illustrates a shaft 4 with a first section 5 held in the bar, and a second section 6 extending out of the bar. At the section 5, one or plural bases 7, 8, 9 for positioning the knitting needle 2 at the bar 1 are configured. At the end of the shaft 4, an operating section, e.g., in the form of a hook 10, is disposed. The shaft 4 comprises two parallel, preferably flat side surfaces 11, 12, as evident in particular from FIG. 7, and narrow stripe shaped upper and lower surfaces 13, 14. It is, e.g., rectangular in cross section. The distance between the side surface 11 and the side surface 12 defines the thickness of the needle shaft 4.

Figure 3:
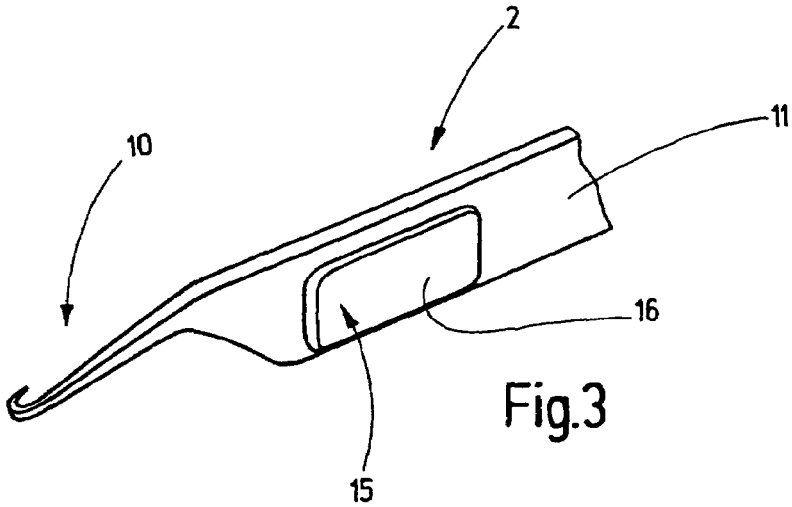
FIG. 3 shows the knitting needle according to FIG. 2 in another size (not to scale) in a perspective view.

As illustrated in particular in FIG. 3, one of the side surfaces 11, 12, in the embodiment the side surface 11, is provided with a plastic body 15, which preferably comprises a flat side 16, which is parallel to the side surface 11. The flat side 16 is preferably oriented in parallel to the side surface 11. The flat side 16 can be a flat continuous surface. If necessary, it can also be provided with one or plural recesses, interruptions, indentations or similar. The distance of the flat side 16 from the side surface 11 corresponds to the portion of the thickness of the plastic body 15, which protrudes beyond the flat side of the shaft 4. The thickness of the overhang of the plastic body 15 thus created coincides with the thickness of the adjacent knitting needles 2, 3 and depends on the pitch and the thickness of the knitting tools and can be selected accordingly. The plastic body of the knitting needle 2 contacts the side surface 12 of the knitting needle 3 with its flat side 16 (plastic-metal contact). The plastic body 15 is furthermore preferably disposed proximal to the hook 10 at the section 6 of the shaft 4, disposed outside of the bar 1. It thus provides a support of the knitting needles at one another outside of the bar 1 proximal to the hook 10.

Figures 4, 5, 6, 7, 8:
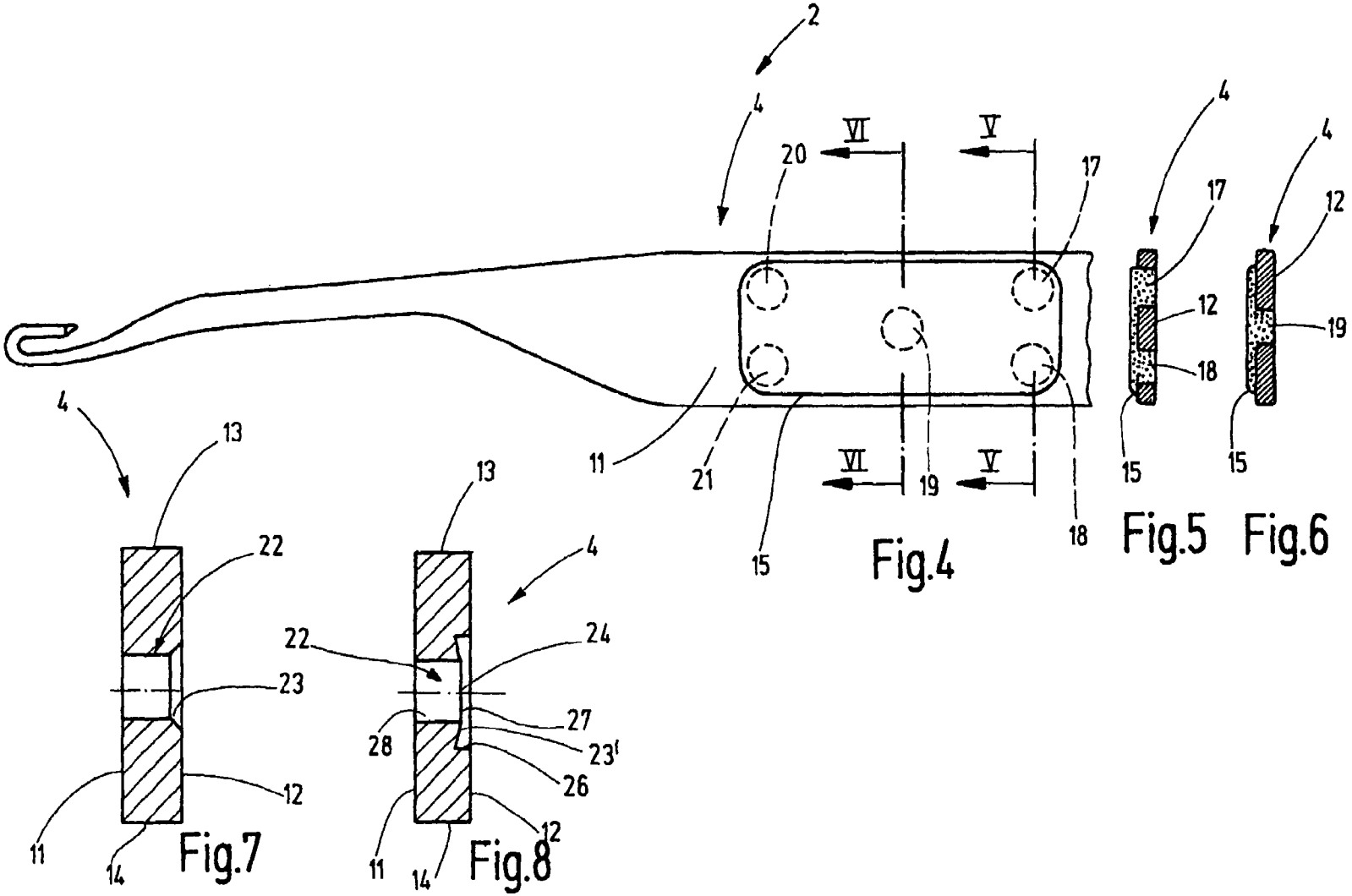
FIG. 4 shows the knitting needle according to FIG. 2 in another size in side view.
FIG. 5 shows the knitting needle according to FIG. 4 cut along the line V-V.
FIG. 6 shows the knitting needle according to FIG. 4 cut along the line VI-VI.
FIG. 7 shows the shaft of the knitting needle according to FIG. 4 according to the cut line of FIG. 6 without a plastic body in another size (not to scale).
FIG. 8 shows the knitting needle according to FIG. 4 cut along the line IV-IV without plastic body with alternative mounting means of the plastic body.

The plastic body 15 is for example approximately rectangular in side view with rounded corners. It is supported by extensions 17, 18, 19, 20, 21 at the shaft 4, which are shown in FIGS. 4 though 6. Said extensions extend through respective openings, which extend transversal through the shaft 4. In FIG. 7, this is illustrated in an exemplary manner with reference to the opening 22, which is used for receiving the extension 19 of the plastic body 15. The opening 22 is, e.g., a bore hole, which is oriented perpendicular to the side surfaces 11, 12, and which transitions into the side surfaces 11, 12 with its ends 27, 28. Thus, at least one end 26 comprises an anchoring means 23. The plastic body 15 is preferably mounted at one side at the shaft 4, as illustrated in particular by the FIGS. 5, 6. It thus comprises a plate shaped section, which extends over a portion of the side surface 11. At the opposite side surfaces 12 the opening 22 ends through an anchoring device 23, which is provided for form locked securing of the plastic body 15 at the shaft 4. Said anchoring device 23 can, e.g., be formed by a funnel shaped expansion of the opening 22.

FIG. 8 shows an alternative anchoring device 23'. The bottom 25 of said anchoring device comprises a flat base surface, which is disposed inclined towards the side surface 12 with reference to its theoretical center 24. The distance of the bottom surface 25 to the side surface 12 of the shaft 4 increases starting at the center 24 towards the rim 26 of the bottom 25. The bottom surface 25 is disposed at an acute angle to the side surface 12. A free space is created by the particular disposition of the bottom surface 25, wherein the plastic body 15 can be anchored in said free space in a particularly safe manner. In another embodiment (FIG. 6), the bottom surface 25 can be disposed at an obtuse angle relative to the side surface 12.

The plastic body 15 is preferably directly molded to the shaft 4. This can be performed in a particular injection mold, into which the shaft 4 is inserted. The plastic is preferably injected into the mold through at least one of the openings used for receiving the extensions 17 through 21. The gate thus created can be disposed within the opening, e.g., within the opening 22. Thus, it does not protrude beyond the side surface 12. The plastic fills the mold and thus forms the plate shaped section at the side surface 11. It furthermore fills the openings and the expansions. Thus, the plastic body 15 is bonded and interlocked with the shaft 4.

Based on the illustrated embodiment of the knitting tool, many variations are possible, e.g., instead of the hook 10, another working section can be provided. The shaft 4 can also have different shapes deviating from the illustrated shape. Furthermore, in addition to the plastic body 15, one or plural additional plastic bodies can be provided at the same side surface 11 or also at the opposite side surface 12. Furthermore, the shape of the plastic body 15 can be varied, like shape, size and number of the openings provided in the shaft 4 for mounting the plastic body 15. However, all the embodiments have in common that the plastic body 15 can be used for lateral support of adjacent knitting needles 2, 3 or other knitting tools.

A knitting needle for a bar 1 of a knitting machine comprises a shaft 4, which is connected to a plastic body 15 at least one side, wherein said plastic body protrudes beyond the side surface 11 of the shaft. Said plastic body 15 is in contact with the side surface of the adjacent knitting tool. Thus, both knitting tools involved support one another.

It will be appreciated that the above description of the present invention is susceptible to various modifications, changes and modifications, and the same are intended to be comprehended within the meaning and range of equivalents of the appended claims.

REFERENCE NUMERALS AND DESIGNATIONS

1 bar
2, 3 knitting tool
4 shaft
5 first section
6 second section
7, 8, 9 bases
10 hook
11, 12 side surfaces
13, 14 narrow sides
15 plastic body
16 flat side
17-21 extensions
22 opening
23 anchoring device
24 center
25 bottom, bottom surface
26 rim
27, 28 ends

What is claimed is:

1. A knitting tool for a knitter comprising:

a shaft, which comprises two side surfaces, and which is configured for stationary support at a bar of the knitter, and which, when the knitting tool is mounted to the bar, is held by a first shaft section in the bar, and wherein a second shaft section protrudes from the bar;

a working portion, configured at the shaft; and at least one plastic body, which is held at the shaft of the knitting tool, which protrudes beyond at least one side surface of the knitting tool, and is anchored at the shaft; and wherein the shaft comprises at least one opening, which is associated with an anchoring device at one end, and which is adjacent to a side surface.

2. A knitting tool according to claim 1, wherein the plastic body is an injection molded component, integrally molded at the shaft.

3. A knitting tool according to claim 1, wherein the plastic body is anchored in a form locked manner at the shaft.

4. A knitting tool according to claim 1, wherein the plastic body is bonded to the shaft.

5. A knitting tool according to claim 1, wherein the anchoring device comprises a bottom, which is disposed at a distance from a side surface.

6. A knitting tool according to claim 5, wherein the distance between the bottom and the side surface changes from a center of the opening towards the rim of the bottom.

7. A knitting tool according to claim 6, wherein the change of the distance of the bottom to the side surface is an increase.

8. A knitting tool according to claim 1, wherein the plastic body only protrudes beyond one of the two side surfaces of the shaft.

9. A knitting tool according to claim 8, wherein the plastic body comprises a section extending along the side surface.

10. A knitting tool according to claim 1, wherein the plastic body comprises a contact surface, which is configured to contact an adjacent knitting tool.

11. A knitting tool according to claim 1, wherein the plastic body extends beyond the side surface of the knitting tool by an amount, which corresponds to the desired lateral distance of adjacent knitting tools.

12. A knitting tool according to claim 1, wherein the plastic body is at least partially disposed at the second shaft section.

13. A knitting tool according to claim 1, wherein the plastic body is exclusively disposed at the second shaft section.

* * * * *